US005813877A

United States Patent [19]

Nakamura

[11] Patent Number: 5,813,877

[45] Date of Patent: Sep. 29, 1998

[54] CONNECTOR FOR FLEXIBLE CIRCUIT BOARDS

[75] Inventor: Hideto Nakamura, Yokkaichi, Japan

[73] Assignee: Sumitomo Wiring Systems, Ltd., Japan

[21] Appl. No.: 803,615

[22] Filed: Feb. 21, 1997

[30] Foreign Application Priority Data

Feb. 23, 1996 [JP] Japan ..... 8-036401

[51] Int. Cl.[6] ..... H01R 11/22

[52] U.S. Cl. ..... 439/267; 439/268; 439/357; 439/495; 439/596

[58] Field of Search ..... 439/260, 267, 439/268, 350, 357, 495, 496, 596, 630, 635, 636

[56] References Cited

U.S. PATENT DOCUMENTS

| | | | |
|---|---|---|---|
| 3,366,919 | 1/1968 | Gammel et al. . | |
| 3,641,482 | 2/1972 | Bretting | 439/596 |
| 4,576,427 | 3/1986 | Verbruggen | 439/636 |
| 5,259,795 | 11/1993 | Yamada et al. . | |
| 5,562,487 | 10/1996 | Ii et al. | 439/495 |

FOREIGN PATENT DOCUMENTS 5691384 7/1981 Japan .

*Primary Examiner*—Neil Abrams

*Assistant Examiner*—Brian J. Biggi

*Attorney, Agent, or Firm*—Jordan B. Bierman; Bierman, Muserlian and Lucas

[57] ABSTRACT

A connector for a printed circuit board having a housing defining a hollow. There is a plurality of slits in the back wall and a terminal is inserted in each one. The terminal includes a pressing piece which is capable of flexing under the influence of the introduction of a retainer so that it is spaced apart from the circuit board. The gap therebetween is greater than the thickness of the board. The housing is also provided with weakened areas, including slits in the sides of the housing and a line of reduced thickness on an upper wall of the housing, which facilitate movement of the upper wall and the pressing piece into the flexed position. The gap therebetween is greater than the thickness of the board. After the retainer and circuit board have been fully inserted, the pressing piece returns to its rest position, in which the gap is equal to or less than the thickness of the circuit board. This provides a good electrical contact between the pressing piece and the board. The retainer, which may be integral with the board, has a cavity which receives a portion of the circuit board. Attached thereto is a connecting member which enters the hollow and presses the terminal into a flexed position separated from the board. In this way, the terminal is out of contact with the circuit board until the board has been fully inserted. This not only prevents damage to the board by abrasion, but also allows entry of a very flexible board without any danger of crumpling, even if the assembly is carried out with one hand.

13 Claims, 4 Drawing Sheets

CONNECTOR FOR FLEXIBLE CIRCUIT BOARDS

This Application claims the benefit of the priority of Japanese Application 8-36401, filed Feb. 23, 1996.

This Invention is directed to a connector for printed circuit boards, particularly those which are flexible. Metal terminals, into which the circuit board is to be inserted, are opened up by a retainer which spreads the terminals until the circuit board has been fully introduced into the connector housing. At that point, the metal terminals are permitted to make contact with the circuit board.

BACKGROUND OF THE INVENTION

The prior art connectors are represented by that disclosed in Japanese OPI 59/91384 and shown in FIG. 10 hereof. Housing 1, having flexible upper wall 1*a*, is provided with opening 2. Pressing portion 4*a* of metal terminal 4 is adapted to engage circuit board 3 when it is inserted into opening 2. Thus, as circuit board 3 is inserted into opening 2, it is necessary for the assembler to flex upper wall 1*a* (and pressing portion 4*a*) into the position shown in dotted lines. This creates space between the two portions of metal terminal 4 and allows easy insertion of circuit board 3. However, as indicated above, it is necessary for the assembler to use two hands in order to complete the insertion. Moreover, there is the danger that circuit board 3 will be pushed between the arms of metal terminal 4 without flexing upper wall 1*a*. In such a case, there is a likelihood of damage to the metal circuits thereon.

SUMMARY OF THE INVENTION

It is among the objects of the present Invention to provide a device whereby assembly can take place with the use of one hand only. At the same time, the opportunity for damaging the circuit board by forcing it into the housing is eliminated.

In accordance with the present Invention, a hollow housing, having metal terminals therein, is provided. The circuit board carries a retainer having a connecting member which, as the board is inserted into the housing, exerts pressure on the arms of the metal terminal to cause them to spread apart. The gap formed thereby is somewhat larger than the thickness of the circuit board. The configurations of the retainer and connector housing are such that, when the circuit board has been fully inserted into the connector housing, the arms of the metal terminal are released and, by virtue of their resilience, move toward each other to press against the circuit board, thereby making good electrical contact.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
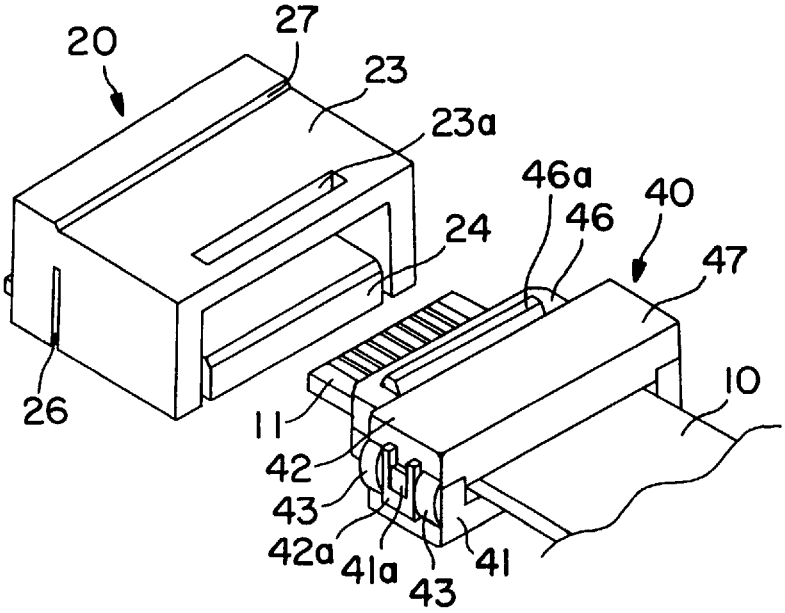
FIG. 1 is a perspective view of a first embodiment of the present Invention, before insertion of the circuit board.
Figure 2:
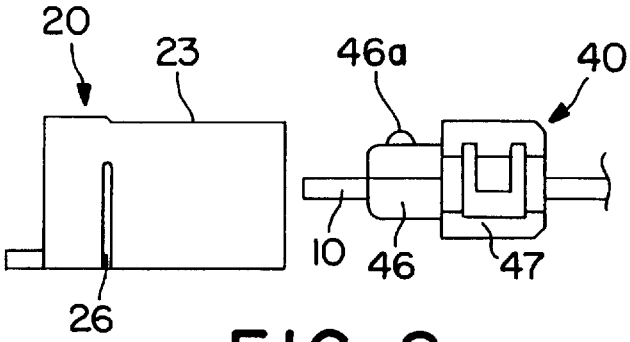
FIG. 2 is a side view of FIG. 1.

Connector housing 20 is provided with upper wall 23, bottom wall 24, and engagement groove 23*a*. In back wall 25 are slits 22 into which metal terminals 30 are inserted. Each of these terminals comprises pressing piece 32, engaged by upper wall 23; attaching claw 31, held in fixing hole 34; and terminal piece 33, projecting out of back wall 25. Pressing piece 32 is provided with projection 32*a*. The gap between the end of projection 32*a* and the adjacent portion of bottom wall 24 of housing 20 is preferably slightly smaller than the thickness of circuit board 10.

Figure 4:
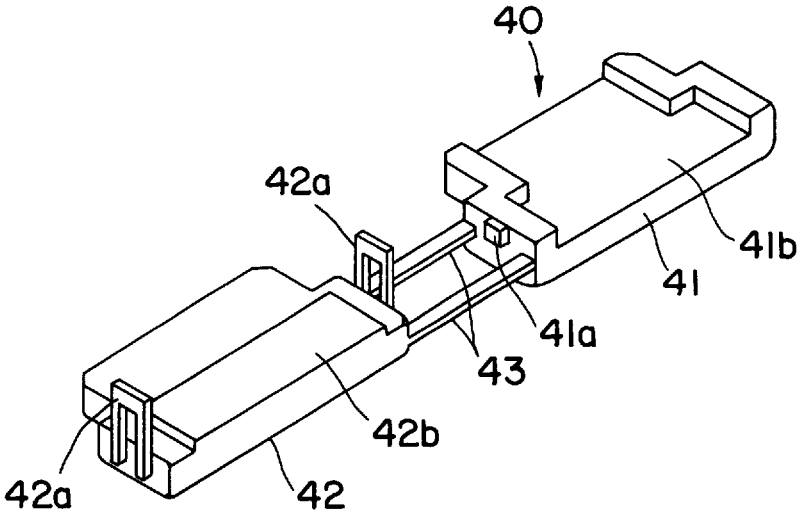
FIG. 4 is a perspective view of one form of the retainer, prior to insertion of the circuit board.

Retainer 40, shown in its open position in FIG. 4, comprises lower casing 41 and upper casing 42 connected by hinge 43. Upper casing 42 is provided with detents 42*a* and lower casing 41 is provided with complementary projections 41*a*. Cavity 41*b* is provided on lower casing 41 and adapted to receive circuit board 10.

Figure 3:
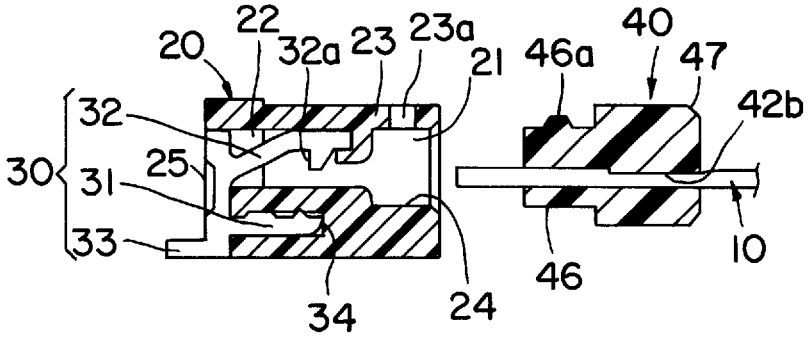
FIG. 3 is a longitudinal cross section of FIG. 2, partly in section.

Circuit board 10 is inserted into cavity 41*b* and upper casing 42 is folded about hinge 43 so that it fits over lower casing 41. Detents 42*a* engage projections 41*a*, thereby locking the retainer in its closed position. In this position, projecting base 42*b* bears against circuit board 10 and fixes it in place. As shown in FIG. 3, connecting member 46 extends forwardly and carries engagement rib 46*a* on its upper surface.

Figure 6:
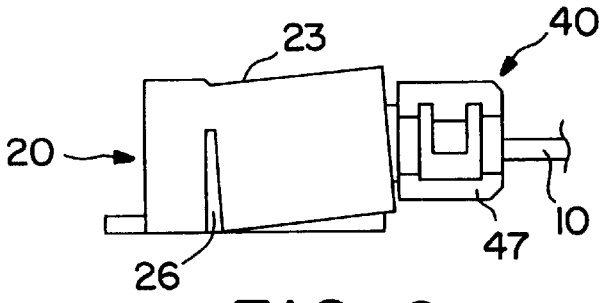
FIG. 6 is a view similar to that of FIG. 2, showing the circuit board partially inserted into the connector housing.
Figure 7:
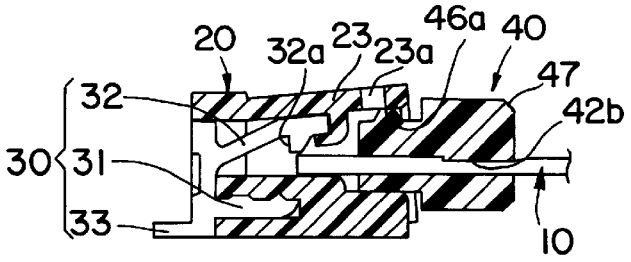
FIG. 7 is a longitudinal partial cross section of FIG. 6.
Figure 8:
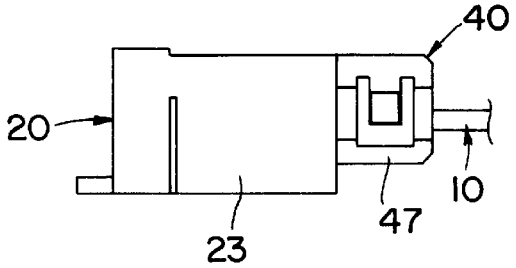
FIG. 8 is a view, similar to that of FIG. 6, wherein the circuit board has been fully inserted into the housing.

The assembly of the connector is particularly shown in FIGS. 3, 6, 7, and 9. After circuit board 10 has been inserted into retainer 40, as previously described, connecting member 46 is introduced into opening 21 of housing 20. Engagement rib 46*a* contacts upper wall 23, thus causing it to flex upwardly as shown in FIGS. 6 nd 7. The housing is also provided with weakened areas which facilitate movement of the upper wall 23 and the pressing piece 32 of the terminal 30 into the flexed position. These weakened areas include slits 26 in the sides of the housing parallel to the back wall 25, and a line of reduced thickness 27 on the upper wall 23 substantially parallel to the back wall. Since attaching claw 31 and pressing piece 32 are held by fixing hole 34 and upper wall 23, respectively, this also flexes pressing piece 32 and increases the gap between projection 32*a* and bottom wall 24. Thus, circuit board 10 can enter the gap without risk of abrasion or other damage.

Figure 9:
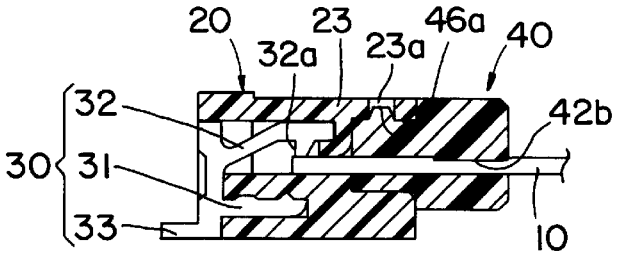
FIG. 9 is a partial cross section of FIG. 8.
Figure 10:
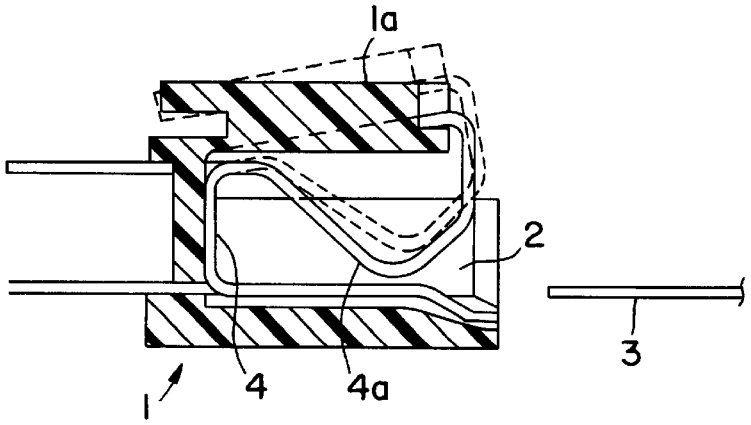
FIG. 10 PRIOR ART
FIG. 10 is a cross section, similar to that of FIG. 3 of a typical prior art device.

When circuit board 10 and retainer 40 are fully inserted into housing 20, engagement rib 46*a* enters engagement groove 23*a*, thereby permitting upper wall 23 to flex downwardly and assume the position shown in FIG. 9. As a result, the gap between projection 32*a* and bottom wall 24 decreases, and projection 32*a* makes good electrical contact with the corresponding circuit on circuit board 10. Since there will normally be a plurality of circuits on circuit board 10, there will be a corresponding plurality of metal terminals 30, each inserted in an appropriate slit 22 in back wall 25 of housing 20. Of course, if circuit board 10 has circuits on both sides, there will be a second pressing piece 32 on terminal 30 so that contact can be made with both sides.

Figure 5:
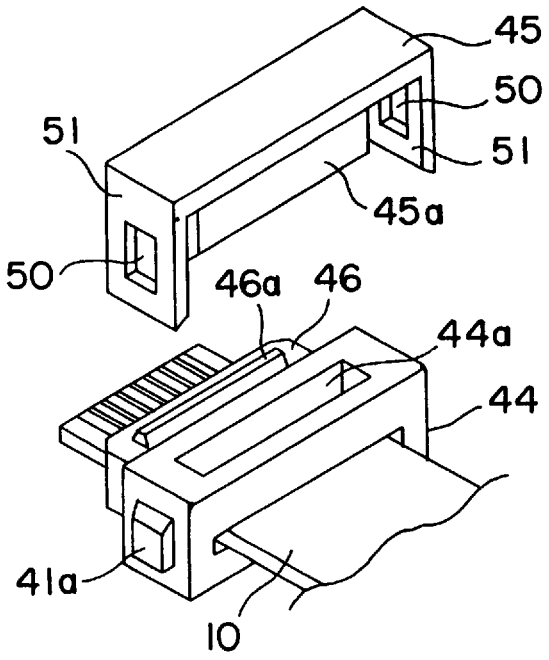
FIG. 5 is an exploded perspective view, similar to that of FIG. 1, of a second embodiment of the present Invention.

A second embodiment of the present Invention is shown in FIG. 5. Cover 45 has openings 50 in each of its depending sides 51. Projections 41*a* corresponding thereto are provided on main casing 44. Connecting portion 46 and engagement rib 46*a* are provided in a manner similar to the first embodiment.

Circuit board 10 is inserted into the slot in main casing 44 and projects out the other side. Thereafter, cover 45 is placed thereover, with projections 41*a* on the sides of casing 44 entering into corresponding openings 50 in the depending sides 51 of cover 45. Pressing portion 45*a* passes through window 44*a* and bears against circuit board 10 to secure it in position. The remaining features and assembly of this embodiment are substantially the same as those of the first embodiment and need not be further described.

While only a limited number of specific embodiments of the present Invention have been expressly disclosed, such changes as would be apparent to those having ordinary skill in the art may be made without departing from the scope or spirit thereof. Circuit board 10 as shown has printed circuits on one side only. However, both sides could be used and terminal 30 would be modified so that there are two pressing pieces 32, one contacting each surface of circuit board 10. Moreover, the specific shape of connecting portion 46 and engagement rib 46*a* can be modified. Instead of the slanting rear surface of engagement rib 46*a*, a squared configuration can be used. This will secure the circuit board more firmly within the housing and make removal thereof more difficult. In addition, the shapes of the various elements may be changed substantially, so long as the basic principle of spreading terminal 30 to prevent or minimize its contact with the circuit board before complete entry is preserved.

Thus, the present Invention provides a ready and simple means whereby assembly of the connector can take place without the necessity of using two hands. Furthermore, even if the circuit board is extremely flexible (and hence cannot force the terminals apart), the board can be introduced into the housing without the risk of crumpling, abrasion, or other damage. In view of the basic nature of the present Invention, it is to be broadly construed and not to be limited except by the character of the claims appended hereto.

What we claim is:

1. A connector for a printed circuit board comprising a connector housing having a front, a back wall, a bottom wall, and an upper wall defining a hollow, a plurality of slits in said back wall, a terminal in each of said slits and including at least one pressing piece having a flexed position, wherein said terminal is spaced apart from said circuit board in a direction normal thereto, thereby forming a gap which is greater than a thickness of said circuit board, and a rest position, wherein said gap is not greater than said thickness and said pressure piece is in electrical contact with said circuit board, a retainer comprising a cavity adapted to receive a portion of said circuit board, and a connecting member, adapted to enter said hollow and urge said terminal into said flexed position before said circuit board enters said gap, said retainer further comprising a cover with depending sides, a main casing adapted to receive said cover, a window in a surface of said main casing, a pressing portion on said cover and corresponding to said window whereby, when said cover is placed on said main casing, said pressing portion bears against said circuit board in said cavity and fixes it in said main casing.

2. The connector of claim 1 wherein said housing comprises a plurality of fixing holes, an attachment claw on each said terminal in each said fixing hole, thereby securing each said terminal to said housing.

3. The connector of claim 1 wherein there is a projection on said pressing piece, said projection adapted to contact said circuit board when said terminal is in said rest position.

4. The connector of claim 1 wherein said pressing piece is held by said upper wall and said attaching claw is held by said bottom wall, at least one of said upper wall and said bottom wall being moveable toward and away from each other in said direction, whereby movement away from each other urges said pressure piece into said flexed position.

5. The connector of claim 1 wherein said pressing piece is biased toward said rest position.

6. The connector of claim 1 wherein said retainer comprises an upper casing, a lower casing, and a hinge therebetween, said upper casing and said lower casing being adapted to be folded together about said hinge into a closed position with said circuit board therebetween.

7. The connector of claim 6 wherein one of said upper casing and said lower casing is provided with at least one projection, and another of said upper casing and said lower casing is provided with at least one detent, complementary to said projection and adapted to engage said projection when said upper casing and said lower casing are folded together with said circuit board therebetween.

8. The connector of claim 1 wherein one of said connecting member and said housing has an engagement rib on a surface thereof, and another of said connecting member and said housing has an engagement groove in a surface thereof, said rib and said groove being complementary to each other when said retainer is in an assembled position wherein said retainer is fully entered in said housing.

9. The connector of claim 8 wherein said connecting member has said engagement rib on one surface thereof and said housing has said engagement groove in a corresponding surface thereof.

10. The connector of claim 1 wherein said housing is provided with weakened areas which facilitate movement into said flexed position.

11. The connector-of claim 10 wherein said weakened areas include at least one slit in a side of said housing parallel to said back wall.

12. The connector of claim 11 wherein there is a slit on each side of said housing and a line of reduced thickness on said upper wall substantially parallel to said back wall.

13. The connector of claim 1 wherein said printed circuit board has circuits on both faces, said terminal has a pair of said pressing pieces, one adapted to bear against each of said faces, said pressing pieces being separated from each other by a gap wider than said thickness of said circuit board when said retainer is inserted into said hollow.

* * * * *